United States Patent [19]

Knoke et al.

[11] 4,451,314

[45] May 29, 1984

[54] METHOD FOR THE MANUFACTURE OF A FLUFFY, LIGHT-WEIGHT, SOFT NONWOVEN FABRIC

[75] Inventors: Jürgen Knoke, Weinheim; Manfred Jöst, Hemsbach; Bohuslav Tecl; Erich Fahrbach, both of Weinheim, all of Fed. Rep. of Germany

[73] Assignee: Firma Carl Freudenberg, Weinheim an der Bergstrasse, Fed. Rep. of Germany

[21] Appl. No.: 446,688

[22] Filed: Dec. 3, 1982

Related U.S. Application Data

[63] Continuation of Ser. No. 268,177, May 29, 1981, abandoned.

[30] Foreign Application Priority Data

Aug. 28, 1980 [DE] Fed. Rep. of Germany ..... 3032398

[51] Int. Cl.[3] ..... B32B 31/16; B32B 5/06

[52] U.S. Cl. ..... 156/148; 28/107; 28/112; 28/115; 156/290; 428/300; 428/301

[58] Field of Search ..... 28/107, 112, 115; 156/148, 290; 428/300, 301

[56] References Cited

U.S. PATENT DOCUMENTS 3,935,046 1/1976 Kiernan et al. ..... 156/148

FOREIGN PATENT DOCUMENTS 7835622 9/1978 Japan ..... 156/148

*Primary Examiner*—Robert A. Dawson
*Attorney, Agent, or Firm*—Kenyon & Kenyon

[57] ABSTRACT

A method is disclosed wherein a nonwoven fabric composed at least in part of thermally fusible fibers is at least partially fused and then is punched by needles to produce a soft, fluffy fabric that resists mechanical wear.

7 Claims, No Drawings

METHOD FOR THE MANUFACTURE OF A FLUFFY, LIGHT-WEIGHT, SOFT NONWOVEN FABRIC

This is a continuation, of application Ser. No. 268,117 filed May 29, 1981 and now abandoned.

BACKGROUND OF THE INVENTION

Light-weight, soft, nonwoven fabrics are known. They have many applications and are especially useful as interlining materials joined to outer textile materials. In addition, they are useful in combination with woven or knitted textiles.

Nonwoven fabrics are typically bonded by binders. Recently, methods have been developed in which the bonding is achieved by means of interfusing some of the fibers of the nonwoven fabric, the so-called spot-fusion technique.

Spot-fused nonwoven fabrics are well suited for use as interlining nonwoven fabric materials. The technique is widely used for large-area fixation of such textile materials, typically having fabric weights of $30\times50$ g/m$^2$ and it does not require the use of adhesive compounds. In general, however, with heavier spot-fused fabric materials, insufficient volume and a feel which is somewhat too firm are obtained when using such a nonwoven fabric material as interlining.

Soft, roughened woven and knit fabrics have also been recently used as interlining materials. These are bulkier and softer than conventional interlining nonwoven fabrics within the heavy weight class of 50 g/m$^2$ and above. A roughening technique gives the woven or knit fabrics a soft feel and a textile-like draping as well as good bulk. It has therefore been attempted to give better bulk to nonwoven spot-fused fabrics by a roughening technique similar to that used for woven and knit fabrics. These attempts have not been successful because the roughening process pulls out individual fibers and brings them to the surface of the nonwoven fabric. Coating the roughened fabric with an adhesive compound also does not work well because the loosened fibers are detached by washing or dry-cleaning.

The objects of the invention, therefore, are to develop a fluffy, especially light-weight, soft nonwoven fabric which has good mechanical utility properties and good resistance to washing and dry-cleaning.

SUMMARY OF THE INVENTION

These and other objects are achieved by a method for manufacturing a fluffy, light-weight, soft, nonwoven fabric according to the present invention which comprises fusing a nonwoven web of staple or endless fibers or both which at least in part are thermoplastically softenable to form a nonwoven fabric and subsequently punching one or both sides of the nonwoven fabric with needles to produce about 20 to 100 punctures per sq. cm. of nonwoven fabric, the penetration of the needles being such that a fluffy surface is produced on the emergent side. Preferred methods of fusing include heating and pressing with calenders and thermally fusing followed by pressing with calenders. Thus, according to the method of the invention, a nonwoven fabric is needle-punched on one or both sides at high speed. The punching produces a fluffy surface on the emergent side of the fabric, i.e., the side through which the needle points emerge. This surface is highly resistant to mechanical action and remains unchanged after several dry-cleaning or washing. Unlike a roughened nonwoven fabric, in which the fibers are not firmly anchored at the surface, no disruption due to nap formation occurs. For the purposes of the invention, spot-fused nonwoven fabrics are particularly preferred.

DETAILED DESCRIPTION OF THE INVENTION

It is surprising that the needle-punching after fusing leads to greater softness, fluffiness and the other properties of the product obtained. Nonwoven fabrics which are needle punctured before bonding or fusing are by no means soft or fluffy. They are customarily used for needled felt bottom linings and as backing for artificial leather. In this needle punching process, the needles are inserted into the nonwoven web which further entangles the fibers of the fabric produced by bonding and leads to an improvement of the fabric's mechanical properties. The resistance to the action of washing and dry-cleaning is also improved. Such needle insertion does not create a soft and fluffy material, the low speeds of such insertion are uneconomical and the surface smoothness is not satisfactory. Therefore, it is surprising that needle-punching, after fusing a nonwoven web as performed according to the invention, produces a soft, fluffy nonwoven fabric that resists mechanical wear.

As the working web, transversely arranged nonwoven webs are preferred. Longitudinal nonwoven webs reinforced by means of fused adhesive fibers are also suitable. The webs are composed of staple fibers, endless fibers or both. The fusion is preferably accomplished by means of a calender which has cylinders engraved at least on one side. The cylinder temperature will depend on the fusion or adhesion temperature of fibers chosen.

Examples of fusible fibers include homofil fibers such as nylon 6, copolyester with a melting range around 200° or polybutylene terephthalate.

Preferred fusible fibers include bicomponent fibers such as nylon 66-nylon 6 or polyethylene terephthalate-copolyester or PAT polybutylene terephthalate.

The fusible fibers are used in an amount of 10 to 100% by weight, relative to the weight of the entire fiber mass. It thus possible to use a nonwoven web which is composed exclusively of thermoplastically softenable fibers, as well as a nonwoven web of fusible fibers and other cofibers such as synthetic polyester, polyamide or polyacrylnitril fibers. Semi-synthetic or natural fibers or mixtures of different fiber types can also be used as cofibers.

Spot-fused nonwoven fabrics are preferred for the process of the invention. Spot fusion can be accomplished by means of a calender with an engraved and a smooth cylinder. Area-fused fabrics may also be used. Area fusion can be accomplished by means of a calender which is equipped with two smooth cylinders. It is also possible to fuse the fibers in the nonwoven fabric without pressure through use of a thermal fusion oven, the subsequent fixation taking place between cold smoothing cylinders.

In general, the desired fluffy and bulky surface of the fabric material which is needle-punched in accordance with the invention is best obtained with spot-fused nonwoven fabric materials. After needle punching, nonwoven fabrics, wherein the fibers have been fused with smooth cylinders, are not as soft as spot-fused fabrics. All of these fabrics, however, have very good resistance to the mechanical abrasion of washing and dry-cleaning.

The needle-punching process can be performed with felting needles and embroidery looms of conventional design. Particularly well-suited is an embroidery loom with 2 boards, each of which is equipped with about 3000 to 6000 needles per meter. Such one-sided needle punching will produce a nonwoven fabric having a relatively smooth needle entrance side and a fluffy, bulky emergence side.

If it is desired to produce a fabric material which is fluffy on both sides, the needle-punching is performed from both sides, advantageously with 2 embroidery looms with 3000 to 6000 needles per meter working width per board, the needles of the one embroidery loom piercing from above and those of the other loom from below.

The depth of penetration is variable and depends on the nature of the fabric material to be needle-punched. The barbs must always penetrate into the material deep enough so that the desired fluffy surface is produced on the emerging side. The depth and density of the fluffy surface depend on the depth of penetration, the needle density, the shape of the barb and on the fineness of the needles.

For heavier material with coarse fibers, somewhat coarser needles are preferred. Needles of 36 to 38 gauge, which have 2 to 3 barbs per needle, have been found suitable. For lighter fabric materials it is more advantageous to use finer needles of about 41 to 44 gauge and with only 1 to 2 barbs. Also the required number of punctures is dependent on the nature of the working fabric. Needle punctures of 20 to 100 per $cm^2$ and in particular 25 to 60 punctures per $cm^2$ have been found suitable.

The method is very economical. With about 5000 needles/per meter per board and 2 boards per embroidery loom or with 2 embroidery looms each with one board of 5000 needles, very high speed can be obtained. Thus, it is possible to achieve a speed of 24 meters per min. with 38 punches per sq. cm. using 10,000 needles per meter of working width.

The nonwoven fabric, needle-punched in accordance with the invention, can be dyed or otherwise finished in any manner desired.

EXAMPLE 1

Fused, Punched, Nonwoven Nylon Fabric

A fiber mixture of 30% by weight nylon 66 with a strength of 1.7 dtex, 20% by weight polyester with a strength of 3.3 dtex and 50% by weight of a core jacket bicomponent fiber which consists 50% by weight of nylon 6 and 50% by weight of nylon 66 having a strength of 3.3 dtex, was carded on a carder. The resulting web was deposited on a slat conveyer by means of a transversal laying device. Subsequently, the web was spot-fused by means of a calender having a smooth cylinder and an engraved cylinder with dot dimensions of $0.55 \times 0.8 \times 0.65$ mm as well as 30 dots/$cm^2$ (dot spacing in the horizontal rows 2.1 mm, 1.6 mm in the vertical rows) at a temperature of 225° C. and a pressure of 50 kg/$cm^2$. The delivery speed was 10 m/min and the weight of the calendered fabric was 60 g/$m^2$. The width was 1 m.

The resulting nonwoven fabric was then passed through an embroidery loom with 2 boards having 5000 needles/m of 40 gauge and 3 barbs per side (9 barbs for 3 sides). The strokes were at 1000/min and the penetration was 14 mm. All three barbs per side pierced the fabric. The running speed was about 24 m/min and the number of punches per $cm^2$ was 38. A material fluffy on one side was produced which draped very well and was soft and bulky.

EXAMPLE 2

(Comparison Test)

Fused, Nonwoven Nylon Fabric

A bonded fabric was prepared as in Example 1, but the subsequent needle punching was omitted. A harder, flatter fabric was produced which could not be adequately draped and in which the fluffy character of the surface was lacking.

EXAMPLE 3

Punched, Fused, Nonwoven Nylon Fabric

A nonwoven web of the same composition as in Examples 1 and 2 was carded, placed transversely and needle-punched. The following conditions were chosen:

2 needle boards (equipped with needles from above), 6 m/min, 700 strokes, 12 mm piercing depth. This web was then spot-fused under the same conditions as in Example 1 at 10 m/min in a calender with an engraved and a smooth cylinder at 225° C. The fabric obtained in this manner exhibits a hard and firm feel and its properties compared with those of a fabric according to Example 2. However, the surface was less smooth than those of the fabrics prepared in accordance with Examples 1 and 2.

EXAMPLE 4

Fused, Double-Punched, Nonwoven Nylon Fabric

On a carder, a nonwoven web with a fiber mixture of 50% of the bicomponent fibers as per Example 1 and 50% by weight nylon 66, 3.3 dtex was carded. Subsequently, this web was spot-fused at 225° between 2 calender cylinders, of which one was engraved, under the conditions of Example 1. The delivery speed was again 10 m/min, the weight of the calendered fabric was 100 g/$m^2$ and the width was 1 m.

The nonwoven fabric was then needle-punched using 2 embroidery looms each with one board having 5000 needles/m of 38 gauge and 3 barbs per side (9 barb per 3 sides). The needles alternately punched from above and below. The stroke (frequency) was 1000/min and the piercing depth was 12 mm. All three barbs per side went through the fabric. The running speed was about 24 m/min. The number of punches per $cm^2$ was 38.

A material fluffy on both sides with a soft and bulky feel was produced.

EXAMPLE 5

(Comparison Test)

Fused, Nonwoven Nylon Fabric

A nonwoven fabric was prepared under the conditions of Example 4 but was not subjected to the subsequent needle punching process. This fabric was distinctly harder and flatter than the subsequently needle-punched product. There was no fluffy surface on either side.

Both samples were washed ten times according to typical washing methods (40° C.). The unpunched fabric was frayed somewhat more than the subsequently needle-punched one. Both fabrics did not tend to form a nap. The original feel remained almost unchanged.

Thickness measurements according to standard measurement techniques (DIN 53 855, Part 1) showed: Example 4: 1.1 mm; Example 5: 0.7 mm.

Measurement of the draping ability according to standard test DIN 53 306 showed the following values: Example 4: 57.7%; Example 5: 65%.

We claim:

1. A method for the manufacture of a fluffy, lightweight soft non-woven fabric, comprising the steps of:
   (a) preparing a web of staple or endless fibers or mixtures thereof, at least some of which fibers are thermoplastically softenable;
   (b) forming said web into a non-woven fabric by spot fusing the thermoplastically softenable fibers by heating portions of said fabric to completely fuse said thermoplastically softenable fibers, thereby causing the fibers of said web to become sufficiently bound together in the form of a nonwoven fabric; and
   (c) subjecting said non-woven fabric on one or both sides to needle-punching with barbed needles to produce about 20 to 100 punctures per square centimeter of said fabric, the penetration of the barbs of said needles being sufficient to produce a fluffy surface on the side of the fabric through which said needles emerge.

2. The method according to claim 1 wherein said needles are 36 to 44 gauge and 1 to 2 barbs per side.

3. The method according to claim 1 wherein the fibers of said web are transversely arranged.

4. The method according to claim 1 wherein said needle punching produces about 25 to 60 punctures per square centimeter of said fabric.

5. The method according to claim 1 wherein said thermoplastically softenable fibers comprise bicomponent fibers and are present in said web in an amount of from about 10 to 100% by weight relative to the total weight of the fibers of said web.

6. The method according to claim 1 wherein the forming of said web into a non-woven fabric comprises passing said web between opposed smooth and engraved heated cylinders so as to soften and fuse portions of at least some of the thermoplastically softenable fibers in said web.

7. The method according to claim 1 wherein said barbed needles are felting needles.

* * * * *

UNITED STATES PATENT AND TRADEMARK OFFICE

CERTIFICATE OF CORRECTION

PATENT NO. : 4 451 314

DATED : May 29, 1984

INVENTOR(S) : JÜRGEN KNOKE ET AL

It is certified that error appears in the above-identified patent and that said Letters Patent is hereby corrected as shown below:

In Column 1, line 6, change "Ser. No. 268 117..." to read --Ser.No. 268 177--

Signed and Sealed this

Ninth Day of October 1984

[SEAL]

*Attest:*

GERALD J. MOSSINGHOFF

*Attesting Officer*

*Commissioner of Patents and Trademarks*